US008919677B2

(12) United States Patent
Soteriou et al.

(10) Patent No.: US 8,919,677 B2
(45) Date of Patent: Dec. 30, 2014

(54) INJECTION NOZZLE

(75) Inventors: Cecilia C. E. Soteriou, Lyndhurst (GB); Marion L. Balin, Onzain (FR)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 49 days.

(21) Appl. No.: 13/636,363

(22) PCT Filed: Mar. 15, 2011

(86) PCT No.: PCT/EP2011/053885

§ 371 (c)(1),
(2), (4) Date: Sep. 21, 2012

(87) PCT Pub. No.: WO2011/117113

PCT Pub. Date: Sep. 29, 2011

(65) Prior Publication Data

US 2013/0008983 A1 Jan. 10, 2013

(30) Foreign Application Priority Data

Mar. 22, 2010 (EP) ..... 10157224

(51) Int. Cl.

| | |
|---|---|
| ***B05B 1/30*** | (2006.01) |
| ***B05B 1/34*** | (2006.01) |
| ***F02M 51/00*** | (2006.01) |
| ***F02M 61/18*** | (2006.01) |
| ***F02M 61/06*** | (2006.01) |

(52) U.S. Cl.

CPC ..... *F02M 61/18* (2013.01); *F02M 61/06* (2013.01); *F02M 61/1866* (2013.01); *F02M 61/1893* (2013.01)

USPC ..... 239/585.5; 239/533.3; 239/584; 239/88

(58) Field of Classification Search

CPC ..... B05B 1/30; B05B 1/34; B05B 1/13452; B05B 1/3442; B05B 1/3452; F02M 51/00

USPC ..... 239/533.1–533.12, 584, 585.1–585.5; 123/299, 446, 447, 467, 468

See application file for complete search history.

(56) References Cited

U.S. PATENT DOCUMENTS

| | | | | |
|---|---|---|---|---|
| 6,427,932 | B1 * | 8/2002 | Danckert et al. | 239/533.12 |
| 7,017,840 | B2 | 3/2006 | Kruger et al. | |

(Continued)

FOREIGN PATENT DOCUMENTS

| | | |
|---|---|---|
| DE | 3810467 | 10/1989 |
| DE | 10109345 | 8/2001 |

(Continued)

OTHER PUBLICATIONS

International Search Report dated Apr. 8, 2011.

(Continued)

*Primary Examiner* — Justin Jonaitis
(74) *Attorney, Agent, or Firm* — Mark H. Svoboda

(57) ABSTRACT

An injection nozzle comprising a nozzle body provided with a bore within which a valve needle is moveable, the valve needle being engageable with a valve seating to control fuel delivery through a set of nozzle outlets, said nozzle outlets including respective entry openings defined in a wall of a sac volume of the nozzle body, wherein the valve needle includes a first valve region, a second valve region and a seat region defined by a transition between the first and second valve regions which seats against the valve seating when the nozzle is in a non-injecting state. The valve needle comprises a third valve region adjacent the second valve region, the third valve region having an outer surface defining a curved profile, the end of the outer surface terminating substantially in alignment with the entry openings when the valve needle is engaged with the valve seating.

14 Claims, 5 Drawing Sheets

(56) References Cited

U.S. PATENT DOCUMENTS

| | | | | |
|---|---|---|---|---|
| 7,128,280 | B1 * | 10/2006 | Boecking | 239/533.12 |
| 7,143,964 | B2 * | 12/2006 | Kuegler | 239/533.12 |
| 7,306,169 | B2 | 12/2007 | Matsumura | |
| 2002/0179743 | A1 * | 12/2002 | Haeberer et al. | 239/533.12 |
| 2006/0118660 | A1 | 6/2006 | Kuegler | |
| 2006/0249600 | A1 | 11/2006 | Sako et al. | |
| 2008/0142621 | A1 * | 6/2008 | Kerst et al. | 239/533.12 |

FOREIGN PATENT DOCUMENTS

| | | | |
|---|---|---|---|
| DE | 10315820 | | 5/2004 |
| DE | 10313225 | | 10/2004 |
| EP | 0 283 154 | A1 | 9/1988 |
| JP | 63-248967 | A | 10/1988 |
| JP | 07-063139 | | 3/1995 |
| JP | 2001-227434 | A | 8/2001 |
| JP | 2004-132376 | A | 4/2004 |
| JP | 2005-337192 | A | 12/2005 |
| JP | 2006-009622 | A | 1/2006 |
| JP | 2006-307678 | A | 11/2006 |

OTHER PUBLICATIONS

English Translation of Japan Office Action dated Nov. 12, 2013.

* cited by examiner

INJECTION NOZZLE

CROSS REFERENCE TO RELATED APPLICATIONS

This application is a national stage application under 35 U.S.C. 371 of PCT Application No. PCT/EP2001/053885 having an international filing date of 15 Mar. 2011, which designated the United States, which PCT application claimed the benefit of European Patent Application No. 10157224.4 filed 22 Mar. 2010, the entire disclosure of each of which are hereby incorporated herein by reference.

TECHNICAL FIELD

The present invention relates to an injection nozzle for use in a fuel injection system for an internal combustion engine. It relates particularly, but not exclusively, to an injection nozzle for use in a diesel common rail fuel injection system, and one in which a valve needle of the injection nozzle is controlled by means of a piezoelectric actuator.

BACKGROUND TO THE INVENTION

In common rail fuel injection systems, fuel injectors (typically four, six or eight) are provided to inject fuel at high pressure into the associated combustion cylinders. Each fuel injector includes an injection nozzle having a valve needle which is operated by means of an actuator to move towards and away from a valve seating so as to control fuel delivery by the injector.

A known injection nozzle is shown in FIG. 1, and such an injection nozzle may be incorporated within a direct-acting piezoelectric injector such as described in EP0955901, and is also applicable to indirect-acting, or 'servo', injectors.

With reference to FIG. 1 an injection nozzle 2 includes a metal nozzle body 4 that defines a cylindrically-shaped blind bore 6 within which a needle-like valve member 8 is slidable. The blind end of the nozzle bore 6 is defined by a conical seating surface 10 which blends, in a radially inward direction, into a sac volume 12. The nozzle body 4 also includes a plurality of nozzle outlet passages 14 (two of which are shown), the inner ends of which open through the wall of the sac volume 12.

The valve needle 8 includes a generally cylindrical (upper) region 15 and a generally conical tip section 16 that is sealingly engageable with the seating surface 10. For this purpose, the tip section 16 defines a frustoconical upper region 18 having a cone angle less than that of the conical seating surface 10 and a lower conical region 20 that sits below the upper region 18 and has a cone angle greater than the conical seating surface 10.

The intersection between the upper and lower tip regions defines a seating line 22 that is engageable with the conical seating surface 10, the seating line 22 defining a precise annular engagement point which ensures an effective and durable seal is achieved.

Note that the cylindrical region 15 of the valve needle 8 is slimmer than the surrounding part of the bore 6 so as to define a chamber 24 for fuel, hereinafter referred to as the 'delivery chamber'.

The valve needle 8 is moveable axially, along the longitudinal axis of the injection nozzle 2, so as to control fuel from the outlet passages 14. In use, as the valve needle 8 is moved upwardly, in the orientation shown in FIG. 1, the tip section 16 disengages the seating surface 10 so that high pressure fuel present in the delivery chamber 24 can flow past the tip section 16, into the sac volume 12 and through the outlet passages 14 into an associated combustion chamber. Re-engagement of the tip section 16 with the seating surface 10 closes the outlet passages 14 thus terminating fuel injection.

The Applicant has observed that in such prior art nozzles, during low lift conditions (up to approximately 35% of maximum lift) the fuel flowing past the seating region tends to follow or "stick" to the surface of the valve needle into the sac volume before turning tightly to enter the outlet entry openings. However, as the lift of the valve needle increases and the opening into the sac volume becomes larger, the flow switches to follow or 'stick' to the surface of the sac volume. However, the switching phase from the flow following the valve needle to following the sac surface is not instantaneous and this transition is characterised by a period of flow instability during which period the flow can flap or toggle between following the valve needle or sac wall surface and, in the worst case, this creates a chaotic flow regime in the sac volume.

The flow instability phenomenon described above can encourage nozzle outlet-to-outlet spray variation and also can cause some variation on the axially upward force acting on the valve needle which can lead to hesitation of the valve lift and further spray fluctuations. Furthermore, the shot-to-shot fuel delivery accuracy of the injector is compromised In general, the above factors lead to higher levels of polluting emissions, and a reduction in engine performance and efficiency.

SUMMARY OF INVENTION

It is against this background that the invention has been devised and is defined by an injection nozzle for an internal combustion engine, particularly a compression-ignition or 'diesel' engine, the injection nozzle comprising a nozzle body provided with a bore within which a valve needle is moveable, the valve needle being engageable with a valve seating to control fuel delivery through a set of nozzle outlets, said nozzle outlets including respective entry openings defined in a wall of a sac volume of the nozzle body, wherein the valve needle includes a first valve region, a second valve region and a seat region defined by a transition between the first and second valve regions which seats against the valve seating when the nozzle is in a non-injecting state. The valve needle also includes a third valve region adjacent the second valve region and having an outer surface defining a curved profile, the end of the outer surface terminating substantially in planar alignment with the entry openings when the valve needle is engaged with the valve seating.

Expressed another way, the end of the third region terminates at a position which is substantially coplanar, that is to say, sharing a plane in common, with the inner openings of the nozzle outlets, and preferably the centres of the inner openings.

In the context of injection nozzles which feature a distinct sac volume, the invention provides a major flow efficiency benefit by avoiding the phenomenon of flow instability as the valve needle lifts from a low lift condition through to a more moderate or high lift condition. The shaped third region serves to guide the fuel from the entry of the sac volume to the outlet entry holes so the sac volume no longer acts as a feed reservoir for the nozzle outlets. As a result, the flow instability is substantially eliminated and a more efficient path is provided for fuel to flow from the sac volume entry point to the nozzle holes which increases the flow rate at low lift conditions compared with the known injection nozzle shown in FIG. 1.

The surface of the third region is spaced a predetermined minimum distance from the entry openings of the nozzle outlets which is between 10% and 30% of the entry diameter of the sac volume, and more preferably between 15% and 25% of the entry diameter of the sac volume and most preferably substantially 20% of the entry diameter of the sac volume.

Selecting a minimum clearance between the surface of the third region and the nozzle outlets ensures that fuel flow is not restricted excessively by too tight a clearance between the end region and the sac wall and also ensures that, at higher needle lifts, the end surface does not interfere with the fuel flow into the nozzle outlets.

In one embodiment, the first valve region and the second valve regions are both frustoconical in form and are disposed adjacent one another so as to define a seating line at the mutual boundary. The shaping of the first and second valve regions in this way creates a precise contact point between the valve needle and the seating surface to ensure a reliable seal.

Although other shapes are possible, in one embodiment the third valve region is a neiloidic frustum that adjoins the second valve region at a relative downstream position.

Although in one variant of the invention the third region may terminate in a flat end face so as to define a sharp peripheral edge, the edge may be softened by a suitable chamfer or radius which is less likely to influence the flow of fuel into the sac volume.

In context, the seating surface of the injector nozzle has a relatively large cone angle, for example between 60 degrees and 140 degrees. More preferably, the angle is between 90 degrees and 140 degrees and, most preferably, substantially 120 degrees. It is in the context of injection nozzles having seating surfaces with relatively large cone angles that the problem of flow transition is most prevalent.

Furthermore, the flow transition problem has been observed to be more prevalent in nozzles in which the distance between the seating region and the nozzle outlet entry holes is relatively small—for example between approximately 20% and 60% and, more preferably between 30% and 50% of a seating diameter of the nozzle.

BRIEF DESCRIPTION OF DRAWINGS

Reference has already been made to FIG. 1, which shows a known injection nozzle. The invention will now be described, by way of example only, with reference to the accompanying drawings, in which.

DETAILED DESCRIPTION OF PREFERRED EMBODIMENTS

Figure 2A:
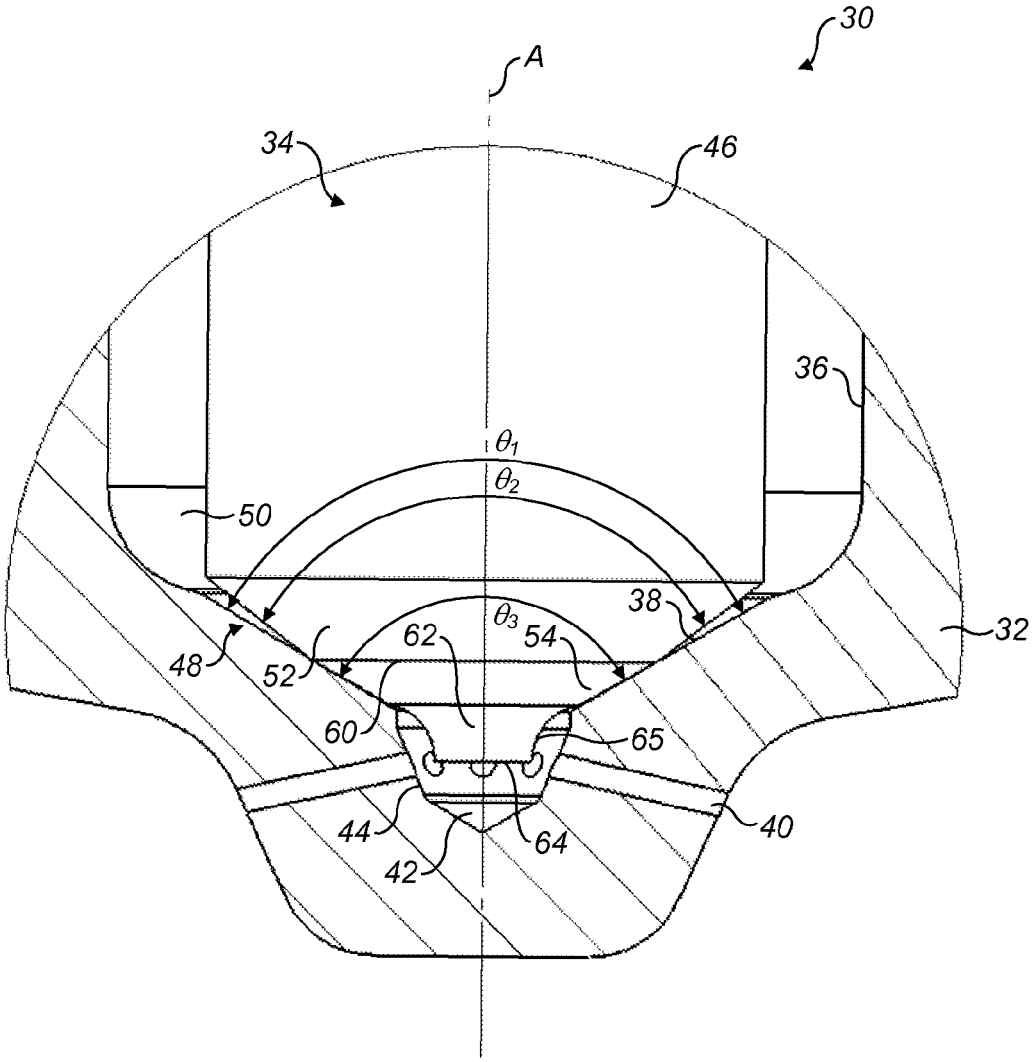
FIG. 2*a* is a part-sectioned view of an injection nozzle in accordance with an embodiment of the invention whilst

Referring to FIG. 2*a*, an injection nozzle (shown generally as 30) comprises an elongate nozzle body 32 and a valve needle 34 which is slidable within a cylindrically-shaped blind bore 36 provided in the nozzle body 32. The valve needle 34 is movable axially to engage with, and disengage from, a valve needle seating surface 38 defined by the blind end of the bore 36 to control fuel delivery through a set of nozzle outlet passages 40 into a combustion chamber (not shown) into which the nozzle 30 protrudes, in use. It should be noted that although the term 'set' is used here as referring to a plurality of nozzle outlets, which is typical in practical applications, the skilled person would appreciate that the term also encompasses a single nozzle outlet.

Although not shown here, in practice the valve needle 34 is moveable by an injection control valve arrangement (not shown) which may be of the type actuated by means of a piezoelectric actuator, as would be familiar to a person skilled in the art, and as exemplified in EP0955901, in the context of a common rail fuel injection system for a diesel engine. It is a particular advantage of the invention that the nozzle can be used in direct-acting piezoelectric injectors, where the piezoelectric actuator controls movement of the valve needle 34 through a direct action, either via a hydraulic or mechanical amplifier or coupler, or by other direct connection means. Alternatively, the valve needle may be moveable by an electromagnetic arrangement or simply by way of hydraulic forces causing the valve needle to lift from its seat, both techniques of controlling valve needle movement being understood by the skilled person.

The valve needle 34 includes a generally cylindrical (upper) region 46 and a generally conical tip section 48 that is sealingly engageable with the seating surface 38 to control fuel flow to the nozzle outlets 40. Note that the cylindrical region 46 of the valve needle 46 is slimmer than the surrounding part of the bore 36 so as to define a chamber 50 for fuel, hereinafter referred to as the 'delivery chamber'.

The seating surface 38 is generally conical in form and defines a cone angle $\vartheta_1$, which in this embodiment, is 120 degrees. The seating surface 38 transitions into a sac volume 42 defined by a steeply sloped wall portion 44 located at the very bottom of the bore 36, and is positioned centrally within the bore having its centre at the longitudinal axis A of the nozzle body 32. Note that the wall of the sac volume 42 is separate and distinct from the conical seating surface 38.

The sac volume 42 serves as a collection bowl or chamber into which the fuel flows from the delivery chamber 50 along an annular path defined between the valve needle 34 and the seating surface 38, and from where the fuel flows into respective inner ends 40*a* of the outlet passages 40 which open at the wall portion 42.

The valve needle 34 is moveable axially, along the longitudinal axis A of the injection nozzle 30, so as to control fuel from the outlet passages 40 depending on whether it is engaged with or disengaged from the seating surface 38. In use, as the valve needle 34 is moved upwardly, in the orientation shown in FIG. 2*a*, the tip section 48 disengages the seating surface 38 so that high pressure fuel present in the delivery chamber 50 can travel past the tip section 48, into the sac volume 42 and through the nozzle outlets 40. Re-engagement of the tip section 48 with the seating surface 38 closes the nozzle outlets 40 thus terminating fuel injection.

It should be noted that the configuration and shape of the tip section 48 particularly is important to the function of the injection nozzle 30 and relatively minor structural variations can have a significant impact on the ability of the injection nozzle 30 to delivery atomized fuel sprays accurately and repeatedly at a range of frequencies (for example between 5 and 200 injection events per second).

In this context, and referring to the tip section 48 in more detail, the valve needle 34 includes a first (upper) region 52 of frustoconical form having a cone angle $\vartheta_2$, which is less than that of the conical seating surface 38, and a second region 54, also of frustoconical form, that adjoins and sits below the upper region 52 and has a cone angle $\vartheta_3$ that is greater than the cone angle $\vartheta_1$, of the seating surface 38. In the embodiment shown, $\vartheta_2$ is approximately 105 degrees and $\vartheta_3$ is approximately 121 degrees, although it should be noted that these values are by way of example only.

Due to the difference in cone angle between the upper and lower regions 52, 54, an intersection line or boundary line 60 is defined between them (hereafter referred to as a seating line 60) that provides a precise annular contact point for the tip section 48 to engage the seating surface 38 thus ensuring an effective seal which is not affected by local variations in the surface roughness of the seating surface 38. Note that the seating line 60 defines a so-called 'seating diameter' of the nozzle.

The tip section 48 is also provided with a third distinct region 62 having a generally tapered form and which adjoins the second region 54 in a downstream position so as to define an end part or section of the valve needle 34. Note that the second region 54 does not extend into the sac volume. In this embodiment, the third region 62 is tapered but is provided with a concave side surface 65. Expressed another way, the geometric shape of the third region 62 is neiloidic in form i.e. a neiloid frustum.

The upper part of the end region 62 that adjoins the second region has a relatively wide diameter and which tapers inwardly to define the curved outer surface 65 and which terminates at a substantially flat end face 64 oriented normal to the longitudinal axis A of the valve needle 34. In this embodiment, the profile of the side surface 65 is defined by an arc of a constant radius.

Note that due to the curvilinear taper of the outer surface 65, the end face 64 has a narrower diameter than the upper part of the end region 62.

Figure 2B:
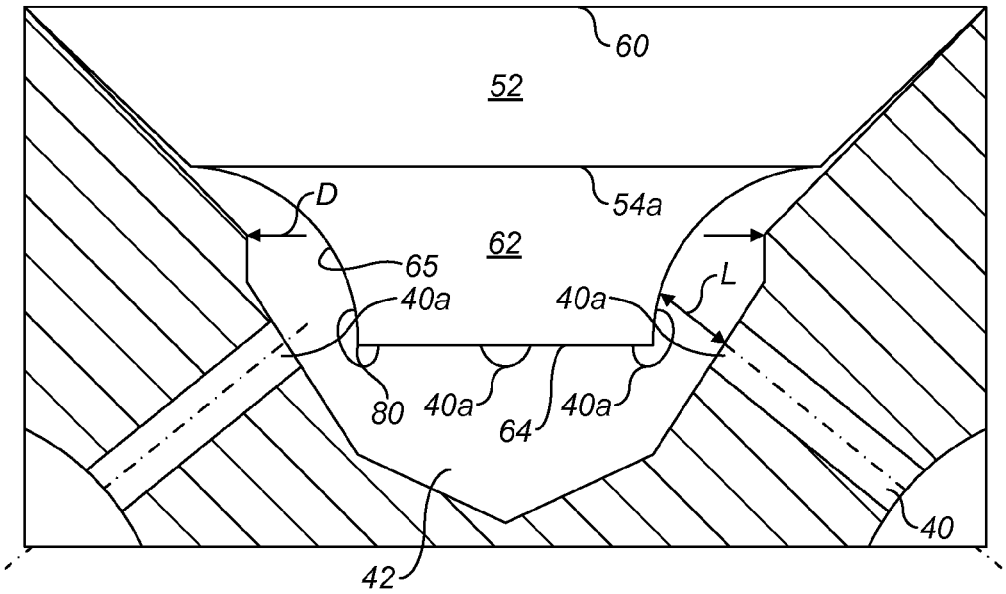
FIG. 2*b* shows a part of FIG. 2*a* in more detail.

When the valve needle 34 is engaged with the seating surface 38, the end face 64 has an axial position which is generally in line with the entry holes 40*a* of the nozzle outlets 40. Referring also to FIG. 2*b* which shows detail of the end region 62 more clearly, it is clear that the curved surface 65 ends at a point which is in alignment, that is to say, coplanar, with a plane defined by the centres of the entry holes 40.

It is notable that in this embodiment, the profile of the curved surface 65 is substantially vertical (in the orientation shown in the drawings) at the point it meets the end face 64. However, this is not essential to the inventive concept and the radius of curvature of the surface 65 may be selected so that the surface 65 defines an oblique angle with the end face 64.

Figure 3A:
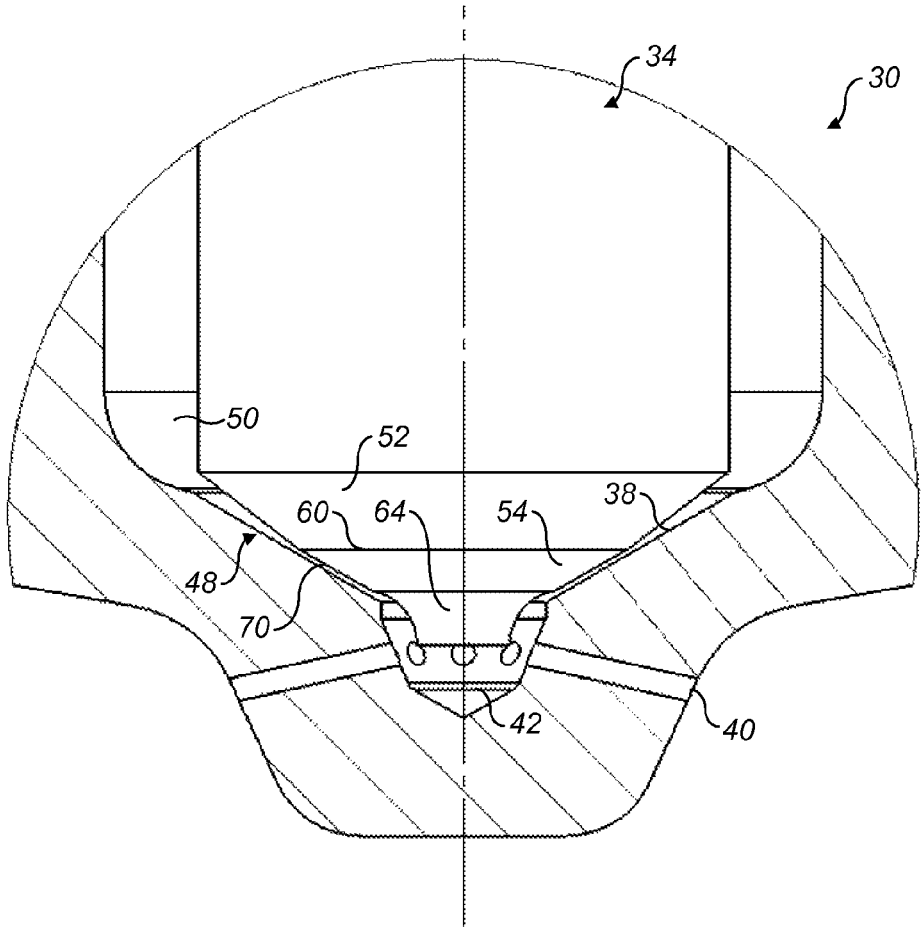
FIG. 3*a* is a part-sectioned view of the injection nozzle in FIGS. 2*a* and 2*b*, but shown in a first injecting position, whilst
Figure 3B:
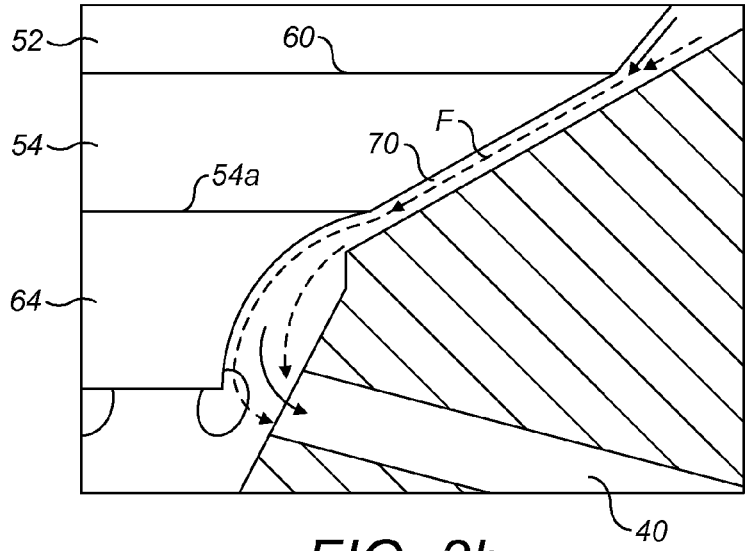
FIG. 3*b* shows an enlarged part of FIG. 3*a*.

Referring now also to FIGS. 3*a* and 3*b*, when the valve needle 34 is in a low lift position, which in practical terms means below about 20% of maximum lift, an annular channel 70 is established between the lower region 54 of the tip section 48 and the adjacent part of the seating surface 38. High pressure fuel therefore flows from an upstream position in the delivery chamber 50 through the annular channel 70 towards the nozzle outlets 40 and the sac volume 42. It should be appreciated that the fuel flowing through the annular channel 70 is required to change direction sharply in order to enter the entry holes 40*a* of the nozzle outlets 40 and, in this context, the function of the third region 64 is to guide fuel flow more effectively into the outlets 40.

As the fuel flow passes the lower edge 54*a* of the second region 54, it encounters the third region 62, the surface of which is curved so as to change the flow direction of the fuel and thus guide it to the inner openings of the nozzle outlet passages along a smooth and continuous path, as is shown clearly in FIG. 3*b* by flow lines F.

Figure 1:
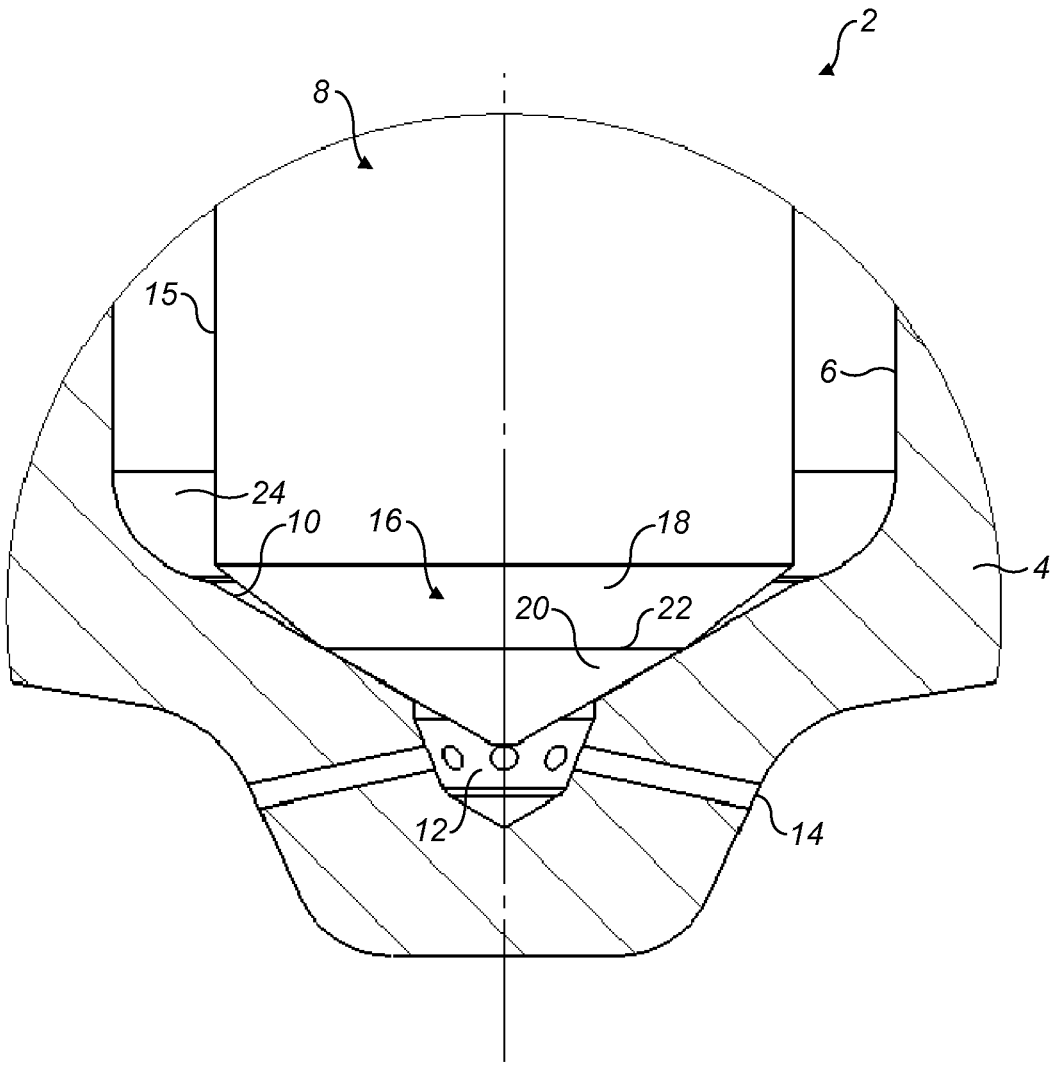

In a low lift condition, the third region 62 provides the fuel flow with a degree of guidance so fuel is less likely to flow into the sac volume 42 in an uncontrolled manner, as has been observed on a prior art nozzle needle such as that in FIG. 1. The end section 62 therefore guards against fuel flow instability, particularly at low and intermediate needle lift heights in which some known nozzles exhibit a hydrodynamic phenomenon sometimes known as 'flow transition'. This transition phenomenon occurs where the fuel flow tends to follow or 'stick' to the surface of the valve needle at very low lifts and then abruptly switches over to follow or 'stick' to the sac wall surface as the valve needle lifts further away from the seating surface. By way of example, the heights of valve needle lift where instability is particularly observed is between 15% and 35% of maximum lift.

Flow instability at low needle lifts can occur in many different nozzle configurations, but the applicant has observed that it is most prevalent in injection nozzles where the cone angle of the seating surface (see cone angle $\vartheta_1$ of the seating surface 38 in FIG. 1) is between 60 and 140 degrees and, more particularly between 90 and 140 degrees.

In this context, it has been observed that the greater the cone angle of the seating surface, the greater the level of increased sac turbulence due to flow instability occurring at low needle lift heights since the fuel flow past the seating line and into the sac volume is required to change direction to a greater degree compared to injection nozzle in which this angle is less severe. So, it is in the context of a fuel injection nozzle having the above parameters that the present invention is particularly beneficial.

Also, flow instability is more likely to occur in nozzle configurations in which the distance between the seating line 60 and the nozzle outlet entry holes 40*a* is relatively low, for example approximately in the range of 20% and 60% of the diameter defined by the valve needle at the point where it engages the seating surface i.e. the seat diameter.

Returning to FIG. 2*a*, and also FIG. 2*b* which shows the end of the valve needle 34 in more detail, it should be noted that the curved surface 65 of the third region 62 is spaced from the entry holes 40 to define an annular clearance or gap L, the minimum dimension of which the applicant has determined is most beneficial at between 10% and 30%, and more preferably between 15% and 25%, of the entry diameter (marked as 'D' on FIG. 2*b*) of the sac volume 42. More preferably, the dimension L is in the range of 17% to 23% and most benefit is obtained with a dimension L of substantially 20% of the entry diameter D of the sac volume 42.

Figure 4A:
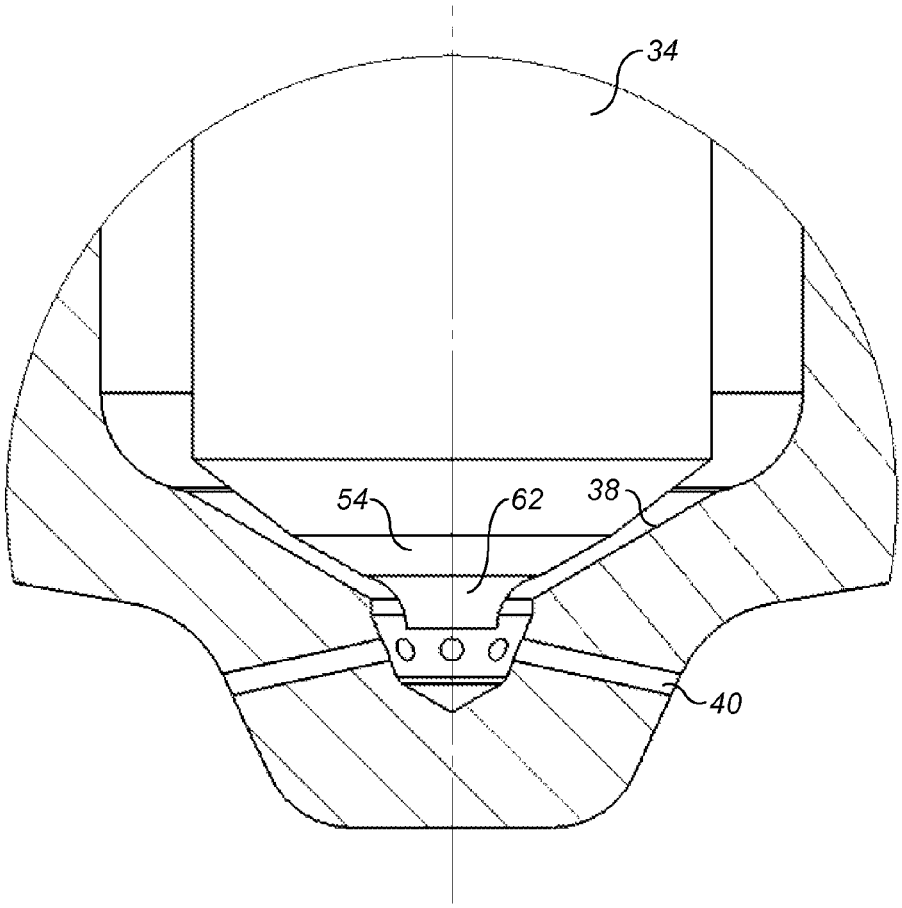
FIG. 4*a* is a part-sectioned view of the injection nozzle in FIGS. 2*a* and 2*b*, shown in a second injecting position, whilst
Figure 4B:
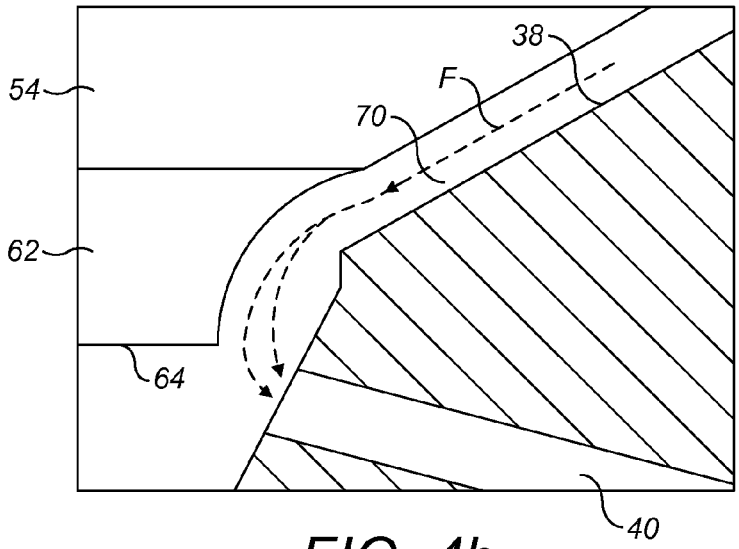
FIG. 4*b* shows and enlarged part of FIG. 4*a*.

This minimum clearance L that the curved surface 65 and, therefore, also the lower end face 64 defines with the internal surface of the sac volume 42 strikes a balance between the requirements of i) ensuring that the fuel flow is not restricted by too tight a clearance between the end region and the sac wall, ii) ensuring that the fuel flow follows the curved surface 65 at low needle lifts and iii) ensuring that, at higher needle lifts, the end surface 65 does not interfere with the fuel flow into the outlets. For example, referring to FIGS. 4*a* and 4*b*, the valve needle 34 is at a greater lift height so the annular channel 70 opened up between the second region 54 and the seating surface 38 is larger than in the low lift position shown in FIGS. 3*a* and 3*b*. The end region 62 is therefore lifted further out of the sac volume 42 into a position where it does not influence fuel flow (shown as F) into the nozzle outlets 40.

Many variations of the injection nozzle are possible without departing from the inventive concept. For example, although the end section 62 is shown with a relatively sharp edge profile 80 between its side surface 65 and the end face 64, the edge 80 could be softened by an appropriate profiling technique, for example a chamfer, or a radius. Furthermore, although the end region 62 of the valve needle 34 has been described above and shown in the figures as having a flat end face 64, it should be appreciated that this is not necessarily the case and that a further shaped section may extend further into the sac volume (i.e. in a downstream direction) from the tapered end region 62. Such a feature may be desirable in order to reduce the dead volume in the sac volume 42 which would have the effect of reducing the amount of fuel in the sac volume that is allowed to 'dribble' or evaporate through the outlets 40 after the valve needle has closed. However, if such a feature is added to the end region 62, it should be appreciated that the feature should maintain a clearance with the outlets 40 of at least equal to the gap L so as to avoid interfering with the fuel flow into the entry holes 40*a* at higher needle lift positions.

Also, although in the above embodiments, the surface 65 has a cross section having a constant radius of curvature, it should be noted that this is not essential to the invention and the radius of curvature may be irregular. For example, the radius of curvature may increase or decrease when considered as extending from the upper end of the end region to the end surface 64. As a further example, the curved surface may comprise an initial conically tapered section which then blends into a curved profile.

The invention claimed is:

1. An injection nozzle for an internal combustion engine, the injection nozzle comprising:

a nozzle body provided with a bore within which a valve needle is moveable along an axis, the valve needle being engageable with a valve seating to control fuel delivery through a set of nozzle outlets, wherein the valve seating transitions into a sac volume of the nozzle body defined by a steeply walled portion located at the very bottom of the bore, said nozzle outlets including respective entry openings defined in a wall of the sac volume, wherein the valve needle includes a first valve region, a second valve region and a seat region defined by a transition between the first and second valve regions and which seats against the valve seating when the nozzle is in a non-injecting state, the valve needle comprising a third valve region, adjacent the second valve region, the third valve region having an outer surface defining a curved profile, the end of the outer surface terminating in alignment with a plane passing through the centers of the entry openings, said plane being perpendicular to the axis, when the valve needle is engaged with the valve seating, wherein the outer surface (65) of the third valve region is spaced a distance (L) from the entry openings of the nozzle outlets of between 10% and 30% of the entry diameter (D) of the sac volume.

2. The injection nozzle of claim 1, wherein the first valve region and the second valve region are frustoconical in form and are adjacent to one another so as to define a seating line at their mutual boundary.

3. The injection nozzle of claim 1, wherein the third valve region is a neiloidic frustum.

4. The injection nozzle of claim 1, wherein the third valve region adjoins the second valve region at a relative downstream position.

5. The injection nozzle of claim 1, where the predetermined distance (L) is between 15% and 25% of the entry diameter (D) of the sac volume.

6. The injection nozzle of claim 5, where the predetermined distance (L) is between 17% and 23% of the entry diameter (D) of the sac volume.

7. The injection nozzle of claim 6, where the predetermined distance (L) is approximately 20% of the entry diameter (D) of the sac volume.

8. The injection nozzle of claim 1, wherein a peripheral edge of the third valve region is chamfered or radiussed.

9. The injection nozzle of claim 1, wherein the valve seating is conical and defines a seat cone angle of between 60 degrees and 140 degrees.

10. The injection nozzle of claim 9, wherein the conical valve seating defines a seat cone angle of between 90 degrees and 140 degrees.

11. The injection nozzle of claim 10, wherein the conical valve seating defines a seat cone angle of 120 degrees.

12. The injection nozzle of claim 1, wherein the distance between the seating region and the nozzle outlet entry holes is between approximately 20% and 60% of a seating diameter of the nozzle.

13. The injection nozzle of claim 12, wherein the distance between the seating region and the nozzle outlet entry holes is between approximately 30% and 50% of a seating diameter of the nozzle.

14. An injection nozzle for an internal combustion engine, the injection nozzle comprising:

a nozzle body provided with a bore within which a valve needle is moveable along an axis, the valve needle being engageable with a valve seating to control fuel delivery through a set of nozzle outlets, wherein the valve seating transitions into a sac volume of the nozzle body defined by a steeply walled portion located at the very bottom of the bore, said nozzle outlets including respective entry openings defined in a wall of the sac volume, wherein the valve needle includes a first valve region, a second valve region and a seat region defined by a transition between the first and second valve regions and which seats against the valve seating when the nozzle is in a non-injecting state, the valve needle comprising a third valve region, adjacent the second valve region, the third valve region having an outer surface defining a curved profile, the end of the outer surface terminating in alignment with a plane passing through the centers of the entry openings, said plane being perpendicular to the axis, when the valve needle is engaged with the valve seating, wherein the outer surface of the third valve region is spaced a distance (L) from the entry openings of the nozzle outlets of between 10% and 30% of the entry diameter (D) of the sac volume.

* * * * *